US006805196B2

(12) United States Patent
Lawrence

(10) Patent No.: US 6,805,196 B2
(45) Date of Patent: Oct. 19, 2004

(54) EXPANDER

(75) Inventor: Lewis Lawrence, Kemnay (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/990,772

(22) Filed: Nov. 16, 2001

(65) Prior Publication Data

US 2002/0104647 A1 Aug. 8, 2002

(30) Foreign Application Priority Data

Nov. 17, 2000 (GB) ..... 0028041

(51) Int. Cl.[7] ..... E21B 43/00

(52) U.S. Cl. ..... 166/297; 166/384; 166/207; 166/55.7

(58) Field of Search ..... 166/297, 384, 166/207, 55.1, 55.7, 55.8

(56) References Cited

U.S. PATENT DOCUMENTS

| | | | | |
|---|---|---|---|---|
| 20,524 A | * | 2/1858 | Gano | 166/207 |
| 761,518 A | | 5/1904 | Lykken | |
| 1,324,303 A | | 12/1919 | Carmichael | |
| 1,545,039 A | | 7/1925 | Deavers | |
| 1,561,418 A | | 11/1925 | Duda | |
| 1,569,729 A | | 1/1926 | Duda | |
| 1,597,212 A | | 8/1926 | Spengler | |
| 1,930,825 A | | 10/1933 | Raymond | |
| 2,011,036 A | | 8/1935 | Colmerauer | 153/81 |
| 2,383,214 A | | 8/1945 | Prout | 153/82 |
| 2,499,630 A | | 3/1950 | Clark | 153/81 |
| 2,600,800 A | | 6/1952 | Pace et al. | 29/90 |
| 2,627,891 A | | 2/1953 | Clark | 153/82 |
| 2,663,073 A | | 12/1953 | Bieber et al. | 29/148 |
| 2,690,783 A | | 10/1954 | Colmerauer | 153/81 |
| 2,898,971 A | | 8/1959 | Hempel | 153/82 |

(List continued on next page.)

FOREIGN PATENT DOCUMENTS

| | | | |
|---|---|---|---|
| EP | 0 153 670 A2 | 4/1985 | B21D/39/06 |
| EP | 0 961 007 A2 | 12/1999 | E21B/33/10 |
| GB | 1 201 435 | 5/1970 | |
| GB | 2 320 734 A | 7/1998 | E21B/33/127 |
| WO | WO 93/24728 | 12/1993 | E21B/17/10 |
| WO | WO 99/18328 | 4/1999 | E21B/23/01 |
| WO | WO 99/23354 | 5/1999 | E21B/43/10 |
| WO | WO 00/37766 | 6/2000 | E21B/29/00 |
| WO | WO 00/37767 | 6/2000 | E21B/29/00 |
| WO | WO 00/37768 | 6/2000 | E21B/29/10 |
| WO | WO 00/37771 | 6/2000 | E21B/43/10 |

OTHER PUBLICATIONS

International Search Report Dated Mar. 11, 2002, for Application Ser. No. PCT/GB01/05068.
U.S. patent application Ser. No. 09/470,176, Metcalfe et al.
U.S. patent application Ser. No. 09/470,154, Metcalfe et al.
U.S. patent application Ser. No. 09/469,692, Trahan.
U.S. patent application Ser. No. 09/469,690, Abercrombie.
U.S. patent application Ser. No. 09/469,681, Metcalfe et al.
U.S. patent application Ser. No. 09/469,643, Metcalfe et al.
U.S. patent application Ser. No. 09/469,526, Metcalfe et al.

*Primary Examiner*—William Neuder
(74) *Attorney, Agent, or Firm*—Moser, Patterson & Sheridan, L.L.P.

(57) ABSTRACT

A tubing expander (10) comprises a body (12) carrying a plurality of radially movable piston-mounted rollers (24) and associated sleeves (16) mounted about the body (12) and being radially supported by the rollers (12). The expander (10) is positioned in a length of cubing of a first diameter, the pistons (28) extended, and the expander (10) rotated such that the sleeves (16) roll around the inner surface of the tubing and expand the tubing to a larger second diameter.

32 Claims, 9 Drawing Sheets

U.S. PATENT DOCUMENTS

| | | | | |
|---|---|---|---|---|
| 3,087,546 | A | 4/1963 | Wooley | 166/46 |
| 3,195,646 | A | 7/1965 | Brown | 166/208 |
| 3,467,180 | A | 9/1969 | Pensotti | 165/180 |
| 3,818,734 | A | 6/1974 | Bateman | 72/75 |
| 3,911,707 | A | 10/1975 | Minakov et al. | 72/76 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,324,407 | A | 4/1982 | Upham et al. | 277/27 |
| 4,429,620 | A | 2/1984 | Burkhardt et al. | 91/395 |
| 4,531,581 | A | 7/1985 | Pringle et al. | 166/120 |
| 4,588,030 | A | 5/1986 | Blizzard | 166/120 |
| 4,697,640 | A | 10/1987 | Szarka | 166/120 |
| 4,848,469 | A | 7/1989 | Baugh et al. | 166/382 |
| 5,271,472 | A | 12/1993 | Leturno | 175/107 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,560,426 | A | 10/1996 | Trahan et al. | 166/120 |
| 5,685,369 | A | 11/1997 | Ellis et al. | 166/195 |
| 5,901,787 | A | 5/1999 | Boyle | 166/135 |
| 6,021,850 | A | 2/2000 | Wood et al. | 166/380 |
| 6,098,717 | A | 8/2000 | Bailey et al. | 166/382 |
| 6,460,615 | B1 * | 10/2002 | Heijnen | 166/207 |

* cited by examiner

EXPANDER

FIELD OF THE INVENTION

This invention relates to an expander primarily intended for use in expanding tubing downhole.

BACKGROUND OF THE INVENTION

It has been proposed to use a roller expander to expand slotted and solid tubing in drilled bores, and in particular in oil and gas wells, such are described in, for example, WO 00/37767, WO 00/37768 and WO 00/37771. A typical roller expander comprises a body carrying a number of radially movable rollers. The rollers may be mounted on pistons or cones such that elevated internal fluid pressure or axial force may be applied to she expander to urge the rollers radially outwardly into contact with a surrounding expandable tube. By simultaneously rotating and advancing the expander a length of tubing may be expanded from a first diameter to a larger second diameter.

It is among the objectives of embodiments of the present invention to provide an improved roller expander for use in such applications.

SUMMARY OF THE INVENTION

According to a first aspect of the present invention there is provided a tubing expander comprising a body carrying at least one radially movable expansion member and a sleeve mounted about the body and being radially supported by the expansion member.

The invention also relates to a method of expanding tubing comprising the steps:

providing a tubing expander comprising a body carrying at least one radially movable expansion member and a sleeve mounted about the body and being radially supported by the expansion member;

locating the expander in a tubing section of a first diameter;

radially extending the expansion member to urge a portion of the sleeve into contact with an internal surface of the tubing section; and rotating the expander such that the sleeve is rolled around the internal surface of the tubing section and expands the tubing section to a larger second diameter.

The invention has particular application in expansion of slotted expandable tubing, in which an unexpanded tubing section features a plurality of overlapping axial slots. Expansion of the tubing is accommodated, at least in part, by bending of the fingers or webs of material between the slots, such that in the expanded tubing the slots assumed a diamond shape. With conventional roller expanders, featuring generally cylindrical rollers or balls mounted around an expander body, the relatively small diameter rollers or balls tend to drop into the slots, that is as the expander rotates and a ball encounters a slot, the ball will be pushed outwardly into the slot and must then be pushed inwardly out of the slot, against the ball actuating force, to allow the ball to move past the slot. The circumference of a typical slotted tube may feature nine slots, and when an expander is being rotated within such a pipe at, for example, 250 rpm, the expander and string will experience a degree of vibration. However, in the present invention the sleeve has a relatively large diameter, such that the sleeve will not drop into the slots to the same extent, the sleeve will tend to bridge the slots, such that the rotating expander experiences less vibration and requires a lower torque to rotate the expander. Of course the expander may be utilise to expand other forms of tubing, including but not limited to solid-walled tubulars, tubulars with other slot patterns, tubulars with holes of a variety of sizes and patterns, tubulars with purposely machined or cast "defects", such as zones of thinned wall, and tubulars which have been longitudinally folded or corrugated into various forms.

Although reference is made above to a tubing section of a first diameter, the invention is not limited to use in tubulars which are initially cylindrical, and as noted above may be utilised in one or both of the unfolding and radial expansion of tubulars which have been longitudinally folded or corrugated into various forms. Further, the invention may be used independently or in combination with other unfolding or expansion tools, devices or mechanisms.

The portion of the tubing section subject to deformation may be relatively short, for example to create a patch or straddle, or to create a hanger or a seal. Alternatively, the tubing section may be of considerable length.

Preferably, the expander comprises a plurality of radially movable expansion members and associated sleeves. In a preferred embodiment, four sets of expansion members and sleeves are provided. Adjacent expansion members Are preferably circumferentially offset. In a preferred embodiment, a first set of two adjacent expansion members are mutually offset by 180°, and a second set of two members are mutually offset by 180° and the first and second sets are offset by 90°. Conveniently, the leading sleeve features a tapered leading end, and may be relatively long. The other sleeves may also feature tapered leading ends. The diameter of the sleeves may increase from the leading end of the expander. Of course particular applications of the expander may require or benefit from the provision of particular numbers of sets of sleeves and members, particular sleeve configurations, and particular expansion member offsets.

The sleeve axis may be adapted to remain parallel to the axis of the tubing section as the sleeve rotate. In such an arrangement it is necessary to apply an external axial force to move the expander axially through the tubing section. Alternatively, the sleeve axis may be skewed relative to the axis of the tubing section, in which case the rotating sleeve, in contact with the tuning section, will act in a similar manner to a screw thread and thus induce an axial force on the expander, minimising or obviating the requirement, to apply an axial force to advance the expander. The outer surface of the sleeve may define a contact surface, such as a helical profile or screw thread, to facilitate creation and transfer of axial force.

Preferably, the expansion member comprise pistons mounted in corresponding blind recesses in the expander body. The recesses may communicate with an axial fluid passage in the body. Conveniently, the recesses are cylinders, facilitating cutting of the cylinders in the body. Most preferably, the expansion members further comprise rollers mounted on piston-mounted axles. Preferably, the axles extend axially of the expander body.

Preferably, the body defines a leading end dimensioned to be a snug fit in the tubing section to be expanded, to stabilize the expander in the tubing

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
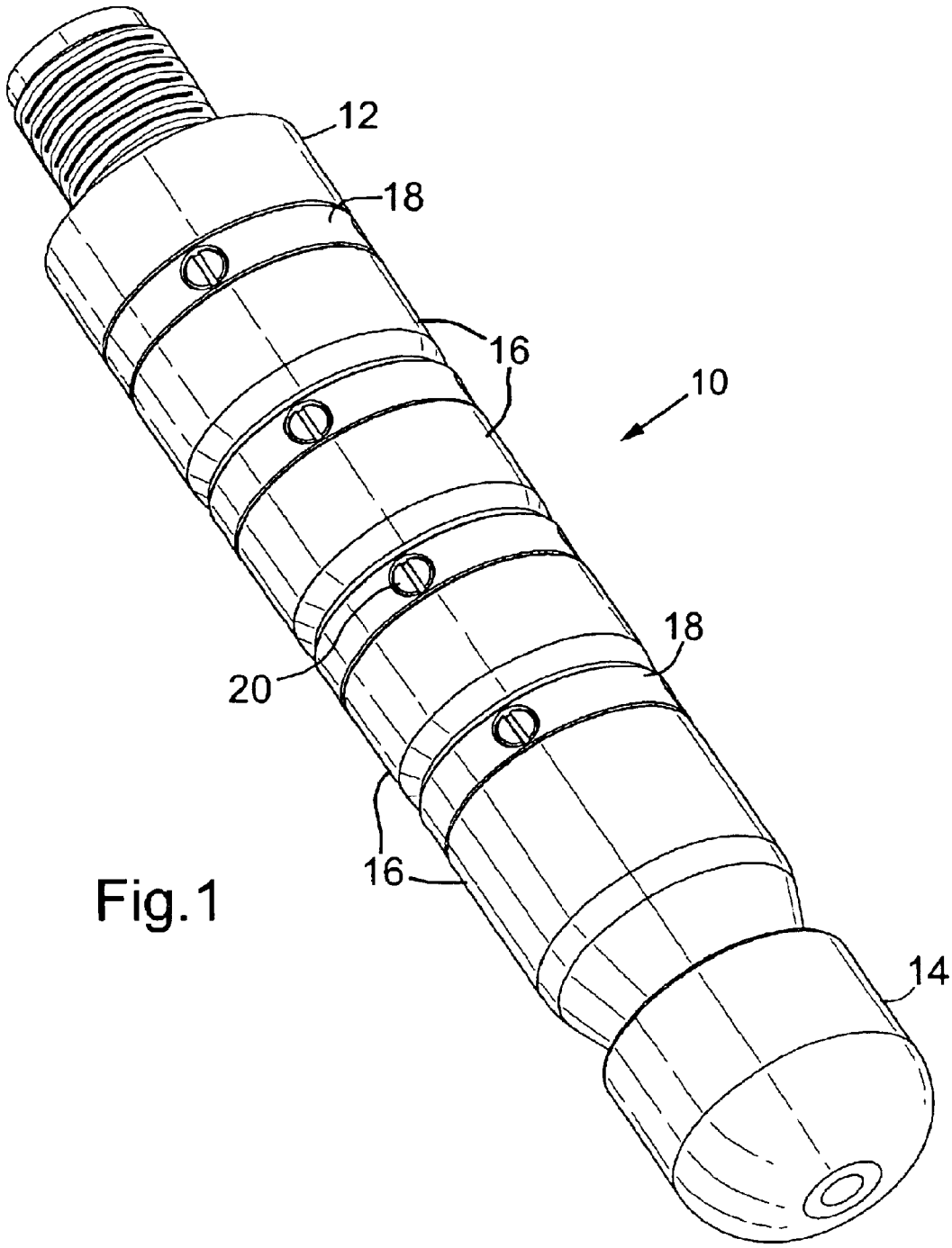
FIG. 1 is a perspective view of a cubing expander in accordance with a preferred embodiment of the present invention.
Figure 2:
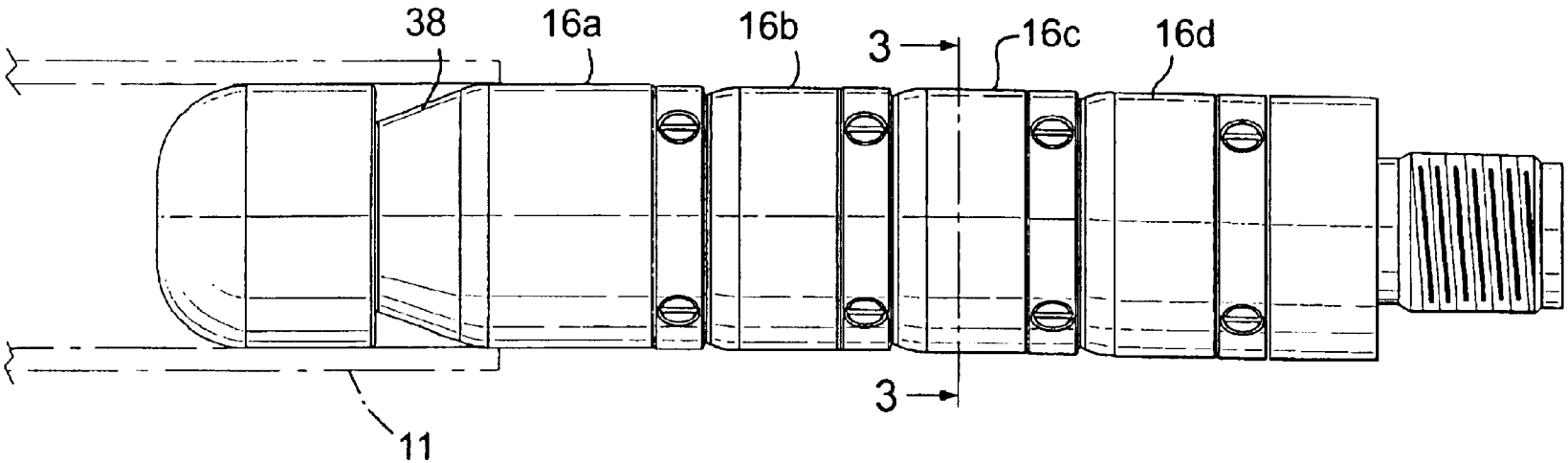
FIG. 2 is a side view of the expander of FIG. 1.
Figure 3:
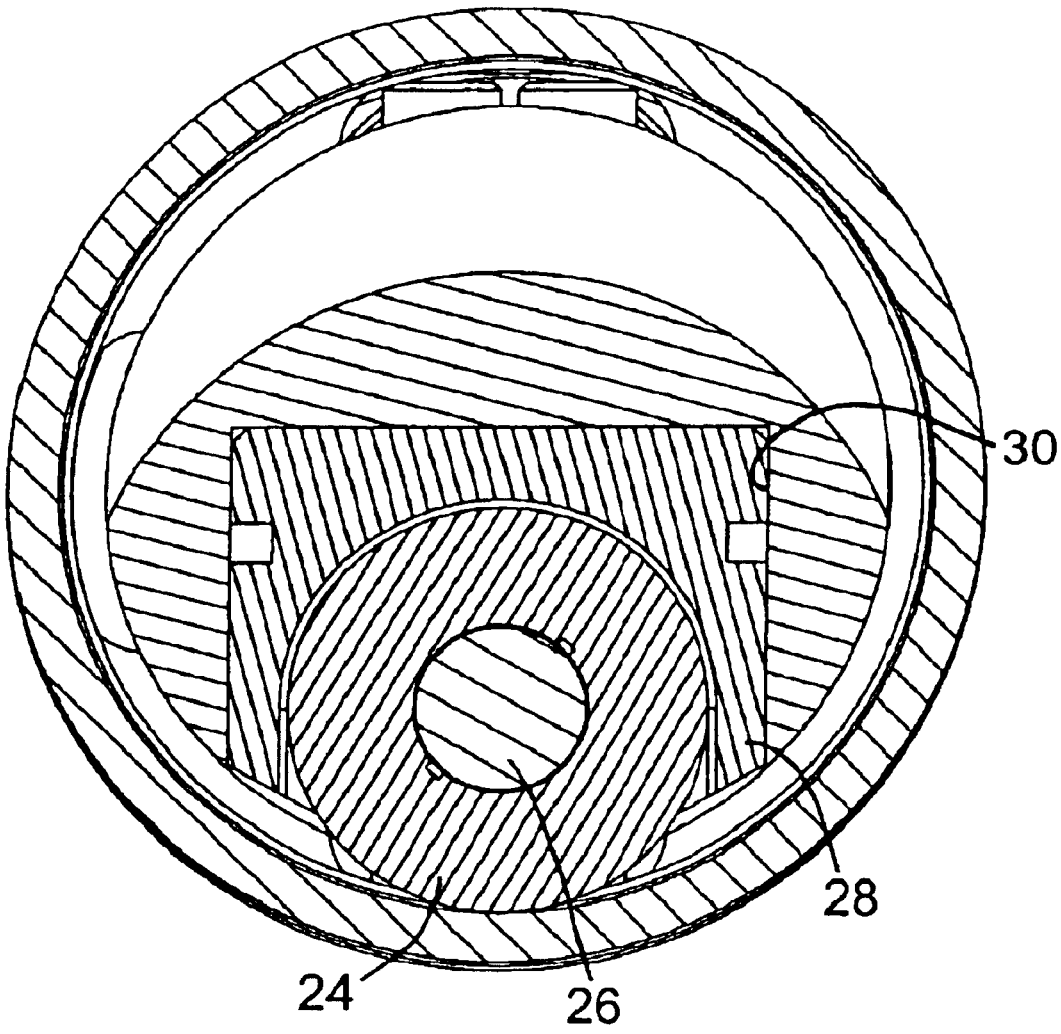
FIG. 3 is an enlarged sectional view on line 3—3 of FIG. 2.
Figure 4:
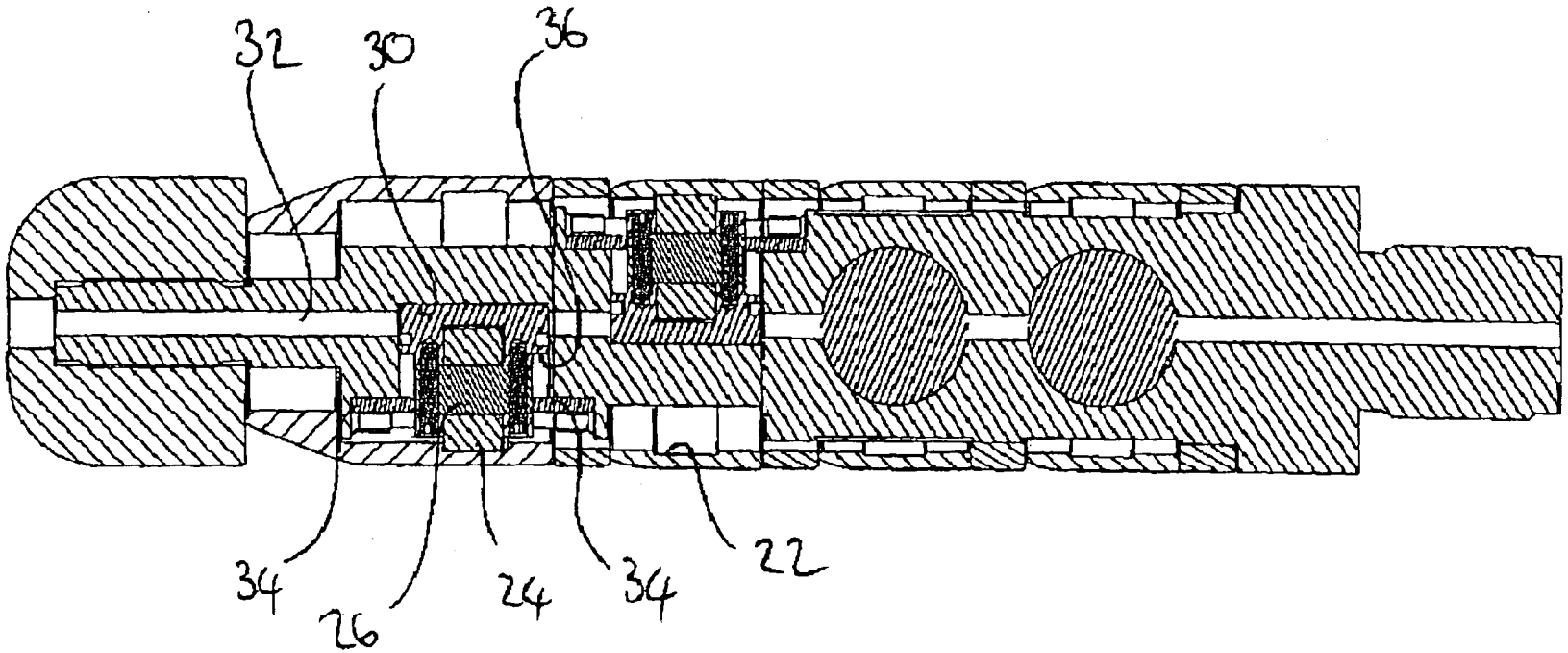
FIG. 4 is a sectional view of the expander of FIG. 1.
Figure 5:
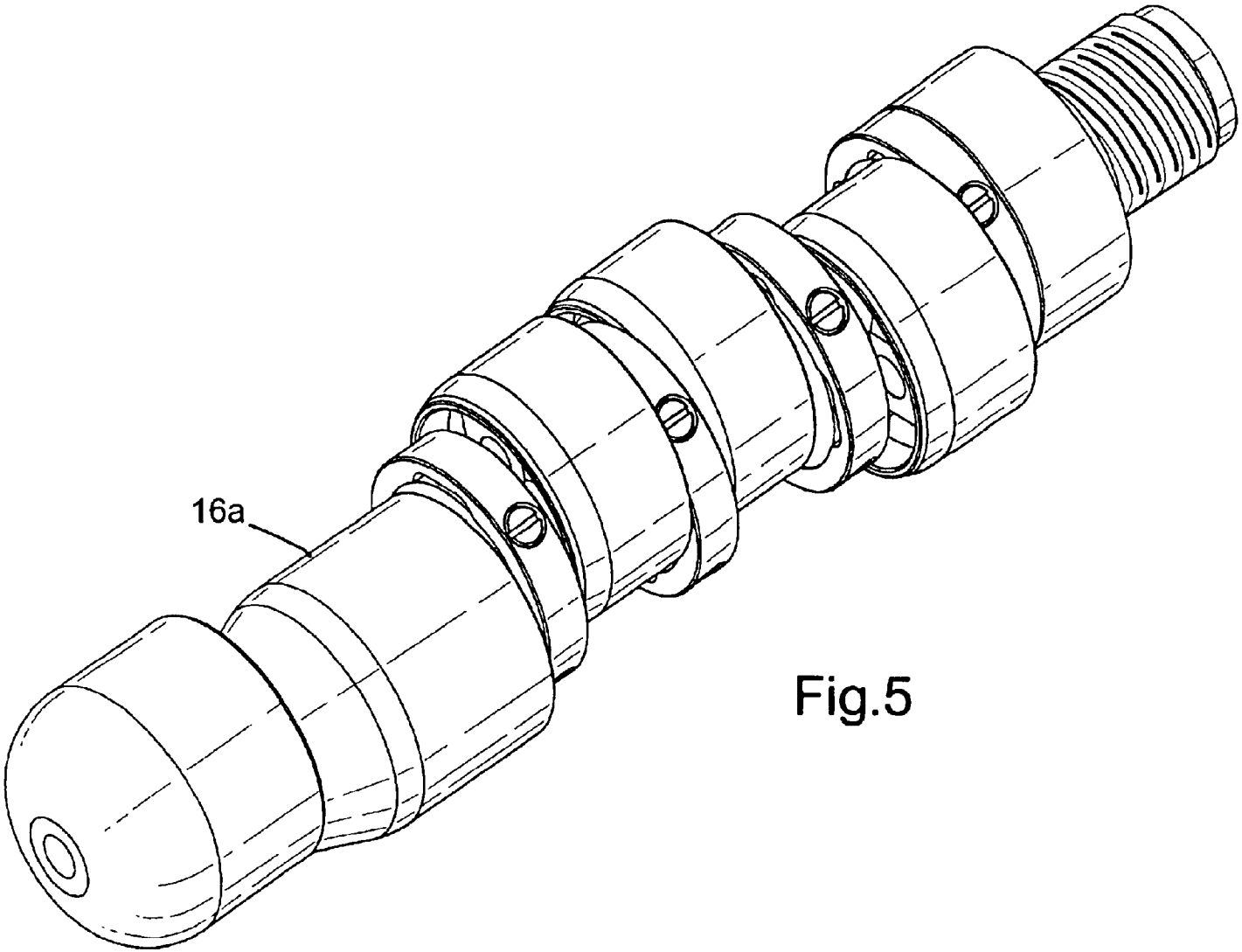
FIG. 5 is a perspective view of the expander of FIG. 1, shown in the actuated configuration.
Figure 6:
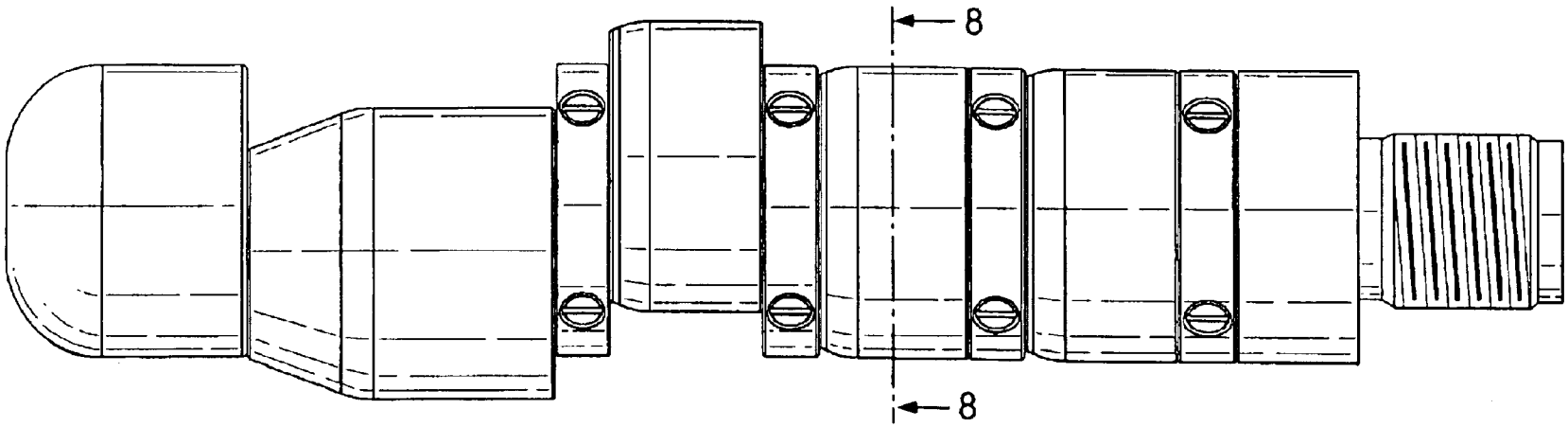
FIG. 6 it a side view of the actuated expander of FIG. 3.
Figure 7:
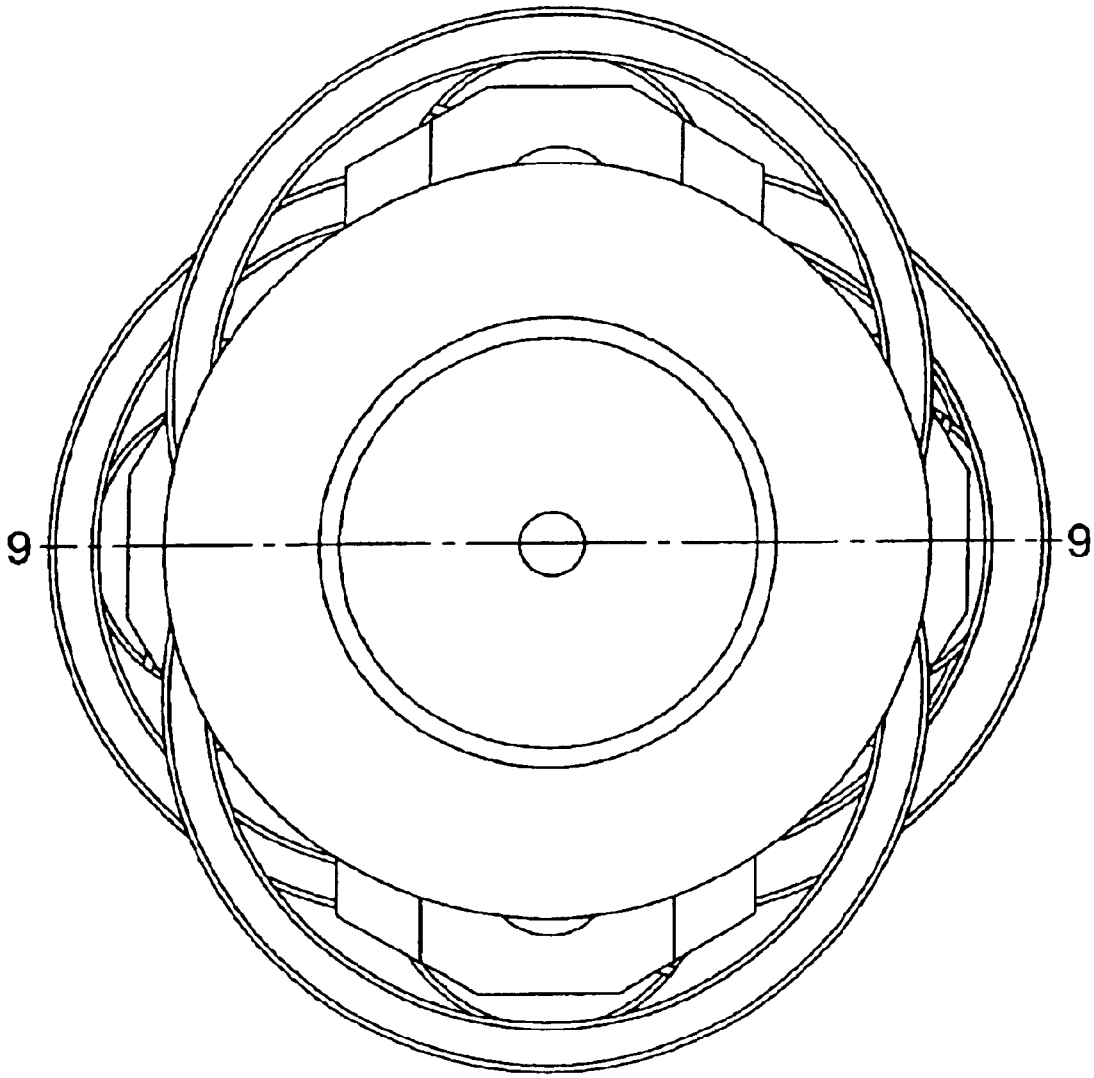
FIG. 7 is an end view of the actuated expander of FIG. 5.

FIGS. 1 to 4 of the drawings illustrates a tubing expander 10 in accordance with a preferred embodiment of the present invention, shown in a retracted configuration. FIGS. 5 to 9 of the drawings illustrate the expander 10 in an actuated or extended configuration. The expander 10 comprises an elongate body 12 adapted for mounting on the end of an appropriate tubular running string (not shown). The leading end of the body carries a rounded nose 14 which is dimensioned to be a snug fit in a tubing section 11 which the expander 10 will be utilised to expand.

Mounted around the expander body 12 are four cylindrical sleeves 16. The sleeves 16 are spaced apart and are located on the body 12 by thrust collars 18 releasably secured to the body 12 by appropriate threaded pins 20. Each sleeve 16 defines an internal circumferential channel 22 (FIGS. 4 and 9) which cooperates with a respective piston-mounted roller 24. Each roller 24 is mounted on an axle 26 pinned to an outer end of a respective piston 28, each piston being radially movable in a blind cylinder 30 formed in the body 12. Each cylinder 30 intersects an axial fluid passage 32 which extends through the expander body 12. Thus, an increase of fluid pressure within the passage 32 tends to urge the pistons 28, and thus the rollers 24, radially outwardly.

The maximum radial travel of each piston 28 is determined by a pair of plates 34 pinned to the body 12 and which are adapted to engage a seep 36 defined on the piston 28.

Figure 8:
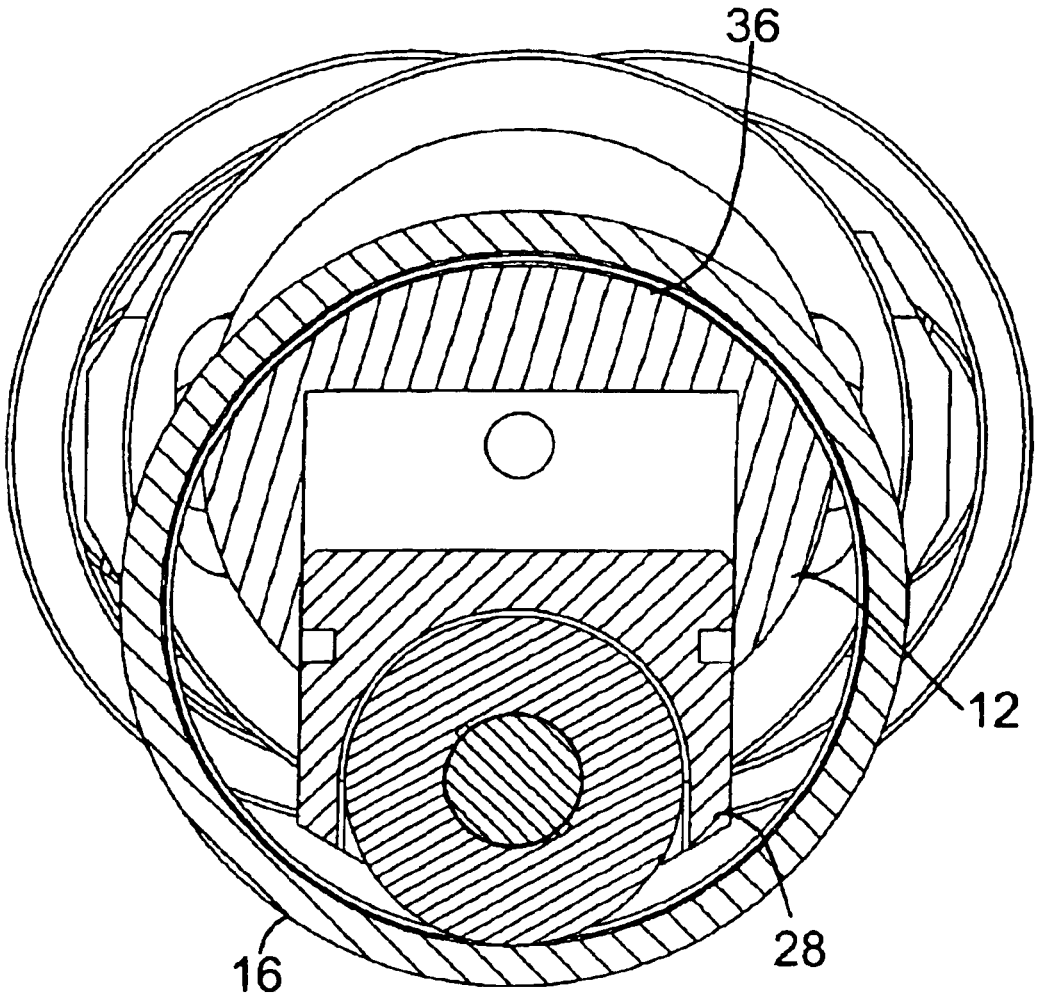
FIG. 8 is a sectional view on line 8—8 of FIG. 6.
Figure 9:
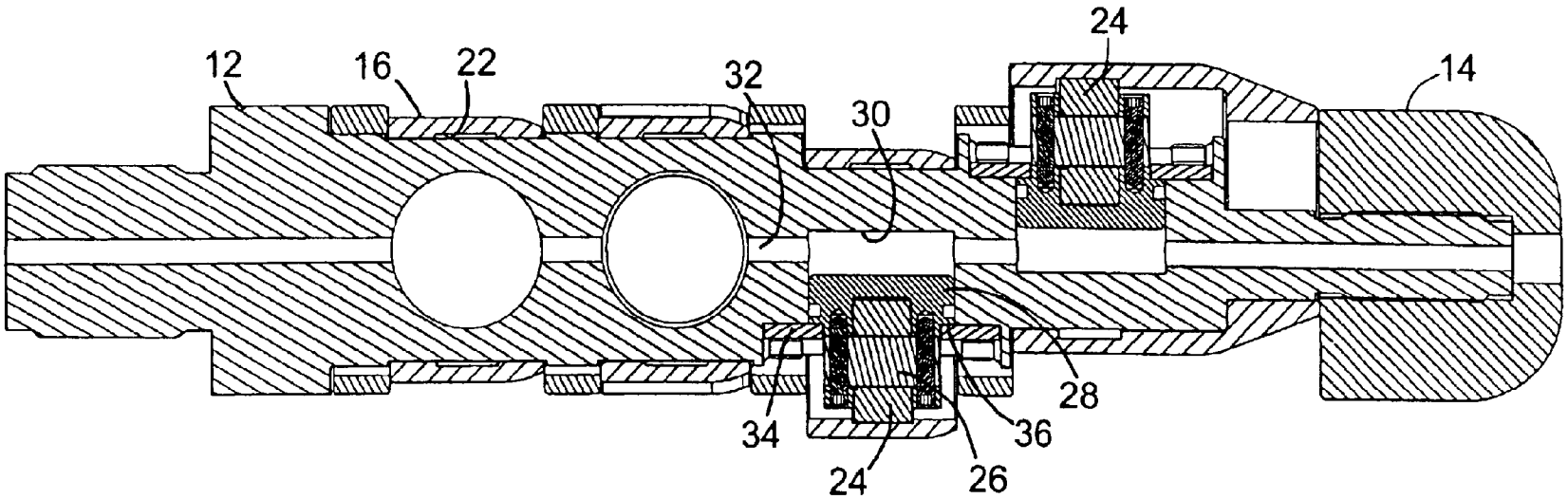
FIG. 9 is a sectional view of the expander of FIG. 5.

Radial extension of a piston 28 carries the respective sleeve 16 to a position in which the sleeve axis is offset from the body axis, as is perhaps best illustrated in FIG. 8. The body 12 is profiled to permit such movement of the sleeves 16, the opposite face of the body 36 at each piston defining an arc of diameter corresponding to that of the sleeve 16 This movement and offsetting of the sleeves 16 results in the actuated expander 10 describing a significantly greater diameter than the retracted expander, and thus a diameter greater than the individual sleeves themselves.

The leading sleeve 16*a* is relatively long in comparison to the other sleeves 16*b*–*d*, and also features a tapering leading end 38 to facilitate the initial expansion of a tubing section 11 from an inner diameter corresponding to the outer diameter of the expander nose 14.

In use, the expander 10 is mounted on the end of a running string, together with a motor, and run into a bore. The expander 10 may be run into the bore together with a section of tubing to be expended, or may be run into tubing section already located within a bore. The expander 10 has particular application in expanding axially slotted tubing, such as sold under the EST trade mark by the Applicant, and as featured in a range of other expandable products supplied by the applicants, such as the sandscreens sold under the EST trade mark. On reaching the location in the bore where the tubing is to be expanded, at least the tubing nose 14 is located in the upper or trailing end of the tubing 11. The fluid pressure within the passage 32 is then increased to extend the pistons 28, and to urge the sleeves 16 towards the fully extended positions a shown in FIGS. 5 to 9. The expander 10 is then rotated and advanced axially into the tubing 11. The sleeves 16 are urged into contact with the internal surface of the tubing 11 and expand the cubing to a larger second diameter. The presence of four mutually offset sleeves 16 (the leading pistons and rollers are arranged to offset the extended sleeve 16*a*, 16*b* by 180°, the trailing sleeve 16*c*, 16*d* are similarly mutually offset, and the leading and trailing sleeve sets 16*a*, 16*b* and 16*c*, are offset by 90°/270°) serves to stabilise the expander 10 in the tubing and provides for a progressive expansion of the tubing.

As will be apparent to those of skill in the art, the relatively large diameter of the sleeves 16 results in the sleeves 16 bridging the slots in the tubing 11, even as the circumferential extent of the slots increases as the tubing is expanded This reduces the vibration experienced by the rotating expander 10, and also reduces the torque necessary to rotate the expander 10.

It will further be apparent to those of skill in the art that the above described embodiment is merely exemplary of the present invention, and that various modifications and improvements may be made thereto without departing from the scope of the invention. For example, the expander may be mounted on any appropriate support, such as coil tubing, in combination with a downhole motor for rotating the expander, or a string of drill pipe, allowing the expander to be rotated from surface. Further, while the present invention has particular application in expanding slotted tubing downhole, the expander may be used in the expansion of other tubing forms, and in other situations

I claim:

1. A tubing expander comprising:

a body adapted for rotation within tubing to be expanded;

at least one radially movable expansion member mounted on the body; and a sleeve mounted about the body and being radially supported by the expansion member, the sleeve being adapted to be offset from the body when the expansion member is actuated to provide a rolling contact with an inner surface of tubing to be expanded as the body is rotated within the tubing.

2. The expander of claim 1, in combination with a section of expandable tubing.

3. The expander of claim 1, in combination with a section of expandable tubing which defines a plurality of openings before or following expansion.

4. The expander of claim 2, wherein the body defines a leading end dimensioned to be a snug fit in the tubing section.

5. The expander of claim 1, wherein the sleeve has an axis adapted to remain parallel to the axis of a tubing section as the sleeve rotates therein.

6. The expander of claim 1, wherein the sleeve has an axis adapted to be skewed relative to the axis of a tubing section as the sleeve rotates therein, whereby rotation of the sleeve, in contact with a tubing section, induces an axial force on the expander.

7. The expander of claim 1, wherein the outer surface of the sleeve defines a contact surface adapted to facilitate creation and transfer of axial force between the sleeve and a tubing section as the sleeve rotates therein.

8. The tubing expander of claim 1, wherein the tubing is located in a wellbore.

9. A method of expanding tubing comprising the steps:

providing a tubing expander comprising a body carrying at least one radially movable expansion member and a sleeve mounted about the body and being radially supported by the expansion member;

locating the expander in a tubing section of a first diameter;

radially extending the expansion member to urge a portion of the sleeve into contact with an internal surface of the tubing section; and rotating the expander such that the sleeve is rolled around the internal surface of the tubing section and expands the tubing section to a larger second diameter.

10. The method of claim 9, comprising expanding the tubing section downhole.

11. The method of claim 9, wherein the tubing section is slotted expandable tubing and expansion of the tubing enlarges the slots.

12. The method of claim 9, comprising stabilising the tubing section on the expander by locating a leading end of the expander in the unexpanded tubing section.

13. The method of claim 9, wherein the tubing section is disposed in a wellbore.

14. A tubing expander comprising:

a body adapted for rotation within tubing to be expanded;

at least one radially movable expansion member mounted on the body; and a sleeve mounted about the body and being radially supported by the expansion member, the sleeve being adapted to be offset eccentrically from the body when the expansion member is actuated to provide a rolling contact with an inner surface of the tubing to be expanded as the body is rotated within the tubing.

15. A method of expanding tubing comprising:

providing a tubing expander comprising a body carrying at least one radially movable expansion member and a sleeve mounted about the body and being radially supported by the expansion member;

locating the expander in a tubing section of a first diameter;

radially extending the expansion member to eccentrically offset the sleeve from the body and urge a portion of the sleeve into contact with an internal surface of the tubing section; and rotating the expander such that the sleeve is rolled around the internal surface of the tubing section and expands the tubing section to a larger second diameter.

16. A tubing expander comprising:

a body adapted for rotation within tubing to be expanded;

at least two radially movable expansion members mounted on the body; and at least two sleeves mounted about the body and adapted to be offset from the body when the at least two expansion members are actuated, wherein the at least two radially movable expansion members and the at least two sleeves are axially separated from each other along a longitudinal length of the body.

17. A method of expanding tubing comprising:

providing a tubing expander comprising a body carrying at least two radially movable expansion members and at least two sleeves mounted about the body along its length and being radially supported by the at least two expansion members;

locating the expander in a tubing section of a first diameter;

radially extending the at least two expansion members to offset the at least two sleeves from the body and to urge portions of the at least two sleeves into contact with an internal surface of the tubing section; and rotating the expander such that the at least two sleeves are rolled around the internal surface of the tubing section and expand the tubing section to a larger second diameter.

18. A tubing expander comprising:

a body adapted for rotation within tubing to be expanded;

at least one radially movable expansion member mounted on the body; and a sleeve mounted about the body and being radially supported by the expansion member, the sleeve being adapted to be offset from the body when the expansion member is actuated to provide a rolling contact with an inner surface of the tubing to be expanded as the body is rotated within the tubing, wherein the expander comprises a plurality of radially movable expansion members and associated sleeves.

19. The expander of claim 18, wherein four sets of expansion members and sleeves are provided.

20. The expander of claim 18, wherein adjacent expansion members are circumferentially offset.

21. The expander of claim 20, wherein a first set of two adjacent expansion members are mutually offset by 180°, and a second set of two expansion members are mutually offset by 180°, and the first and second sets of expansion members are offset by 90°.

22. The expander of claim 18, wherein at least one of the sleeves has a tapered leading end.

23. The expander of claim 18, comprising a leading sleeve having a tapered leading end.

24. The expander of claim 18, comprising a leading sleeve which is longer than the other sleeves.

25. The expander of claim 18, wherein the sleeves increase in diameter from the leading end of the expander.

26. A tubing expander comprising:

a body adapted for rotation within tubing to be expanded;

at least one radially movable expansion member mounted on the body; and a sleeve mounted about the body and being radially supported by the expansion member, the sleeve being adapted to be offset from the body when the expansion member is actuated to provide a rolling contact with an inner surface of the tubing to be expanded as the body is rotated within the tubing, wherein the expansion member comprises a piston mounted in a corresponding recess in the expander body.

27. The expander of claim 26, wherein the recess communicates with an axial fluid passage in the body.

28. The expander of claim 26, wherein the recess is substantially cylindrical.

29. A tubing expander comprising:

a body adapted for rotation within tubing to be expanded;

at least one radially movable expansion member mounted on the body; and a sleeve mounted about the body and being radially supported by the expansion member, the sleeve being adapted to be offset from the body when the expansion member is actuated to provide a rolling contact with an inner surface of the tubing to be expanded as the body is rotated within the tubing, wherein the expansion member comprises a roller for engaging an inner face of the sleeve.

30. The expander of claim 29, wherein the roller is mounted on an axle extending axially of the expander body.

31. A tubing expander, comprising:

a body adapted for rotation within tubing to be expanded:

at least one radially movable expansion member mounted on the body; and a sleeve mounted about the body and being radially supported by the expansion member, the sleeve having a centerline adapted to be offset from a centerline of the body when the expansion member is actuated.

32. A method of expanding tubing, comprising:

providing a tubing expander comprising a body carrying at least one radially movable expansion member and a sleeve mounted about the body and being radially supported by the expansion member;

locating the expander in a tubing section of a first diameter;

radially extending the expansion member to urge a centerline of the sleeve away from a centerline of the body and a portion of the sleeve into contact with an internal surface of the tubing section; and rotating the expander such that the sleeve expands the tubing section to a larger second diameter.

* * * * *

UNITED STATES PATENT AND TRADEMARK OFFICE

CERTIFICATE OF CORRECTION

PATENT NO. : 6,805,196 B2
APPLICATION NO. : 09/990772
DATED : October 19, 2004
INVENTOR(S) : Lewis Lawrence It is certified that error appears in the above-identified patent and that said Letters Patent is hereby corrected as shown below:

Title Page, Item (30)

Foreign Application Priority Data

Please remove "0028041" and replace with -- 0028041.2 --

Signed and Sealed this

Twenty-second Day of January, 2008

JON W. DUDAS
*Director of the United States Patent and Trademark Office*